US008312935B1

(12) United States Patent
Cramton

(10) Patent No.: US 8,312,935 B1
(45) Date of Patent: Nov. 20, 2012

(54) WATER RECYCLING AND FIREFIGHTING TRAINING SYSTEM

(76) Inventor: Richard Cramton, Alta Loma, CA (US)

( * ) Notice: Subject to any disclaimer, the term of this patent is extended or adjusted under 35 U.S.C. 154(b) by 504 days.

(21) Appl. No.: 12/625,126

(22) Filed: Nov. 24, 2009

Related U.S. Application Data

(60) Provisional application No. 61/121,074, filed on Dec. 9, 2008.

(51) Int. Cl.
*A62C 27/00* (2006.01)

(52) U.S. Cl. ..... 169/24; 169/52; 239/125; 239/148; 239/211; 434/221

(58) Field of Classification Search ..... 239/124, 239/125, 146, 148, 149, 211; 169/51, 52, 169/24; 434/226
See application file for complete search history.

(56) References Cited

U.S. PATENT DOCUMENTS 2,198,524 A * 4/1940 Berwick et al. ..... 222/145.5
6,488,216 B1 * 12/2002 Lewis ..... 239/106
7,303,145 B2 * 12/2007 Wysong ..... 239/106
2004/0050556 A1 * 3/2004 Baker et al. ..... 169/15
2005/0233289 A1 * 10/2005 Hoglund ..... 434/226
2006/0240392 A1 * 10/2006 Clifton ..... 434/226

OTHER PUBLICATIONS http://web.archive.org/web/20071221220212/http://www.fdtrainingsystems.com/; FD Training Systems, Inc.; Dec. 21, 2007.

* cited by examiner

*Primary Examiner* — Dinh Q Nguyen
*Assistant Examiner* — Viet Le
(74) *Attorney, Agent, or Firm* — Neustel Law Offices

(57) ABSTRACT

A water recycling and firefighting training system for efficiently practicing connecting water hoses between a water storage tank including a fire hydrant and a fire engine. The water recycling and firefighting training system generally includes a frame having wheels, a storage tank mounted to the frame, a fire hydrant mounted proximate the frame, wherein the fire hydrant is fluidly connected to the storage tank, a pump fluidly connected to the storage tank to pump water to the fire hydrant, and at least one intake fluidly connected to the storage tank for inputting water back within the storage tank. The water from the storage tank is circulated between the mobile trailer and a fire engine through a plurality of hoses in a closed-loop configuration.

13 Claims, 3 Drawing Sheets

WATER RECYCLING AND FIREFIGHTING TRAINING SYSTEM

CROSS REFERENCE TO RELATED APPLICATIONS

I hereby claim benefit under Title 35, U.S. Code, Section 119(e) of U.S. provisional patent application Ser. No. 61/121,074 filed Dec. 9, 2008. The 61/121,074 application is currently. The 61/121,074 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a firefighter training device and more specifically it relates to a water recycling and firefighting training system for efficiently practicing connecting water hoses between a water storage tank including a fire hydrant and fire engine to form a closed-loop water circulation system.

2. Description of the Related Art

Any discussion of the related art throughout the specification should in no way be considered as an admission that such related art is widely known or forms part of common general knowledge in the field.

Fire departments are faced with the task of training their personnel to perform in high stress and dangerous situations. The personnel are often times responsible for safely operating fire pumps on fire engines and quickly connecting water hoses between fire hydrants and the fire engines.

To become efficient at using the firefighting equipment, the personnel must train for many hours, often times using thousands of gallons of water. When training in real environments, the water used for training purposes is often flushed down the drain, thus wasting large amounts of water.

In addition, many cities and jurisdictions do not allow fire departments to flow these large amounts of water to train the personnel for various reasons, such as the large costs associated with using the water, the loss of water to city water systems, the wasting of precious water resources, and to prevent public outcries associated with the large amounts of water wasted. Because of the inherent problems with the related art, there is a need for a new and improved water recycling and firefighting training system for efficiently practicing connecting water hoses between a water storage tank including a fire hydrant and fire engine to form a closed-loop water circulation system.

BRIEF SUMMARY OF THE INVENTION

A system for efficiently practicing connecting water hoses between a water storage tank including a fire hydrant and fire engine to form a closed-loop water circulation system. The invention generally relates to a firefighter training device which includes a frame having wheels, a storage tank mounted to the frame, a fire hydrant mounted proximate the frame, wherein the fire hydrant is fluidly connected to the storage tank, a pump fluidly connected to the storage tank to pump water to the fire hydrant, and at least one intake fluidly connected to the storage tank for inputting water back within the storage tank. The water from the storage tank is circulated between the mobile trailer and a fire engine through a plurality of hoses in a closed-loop configuration.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
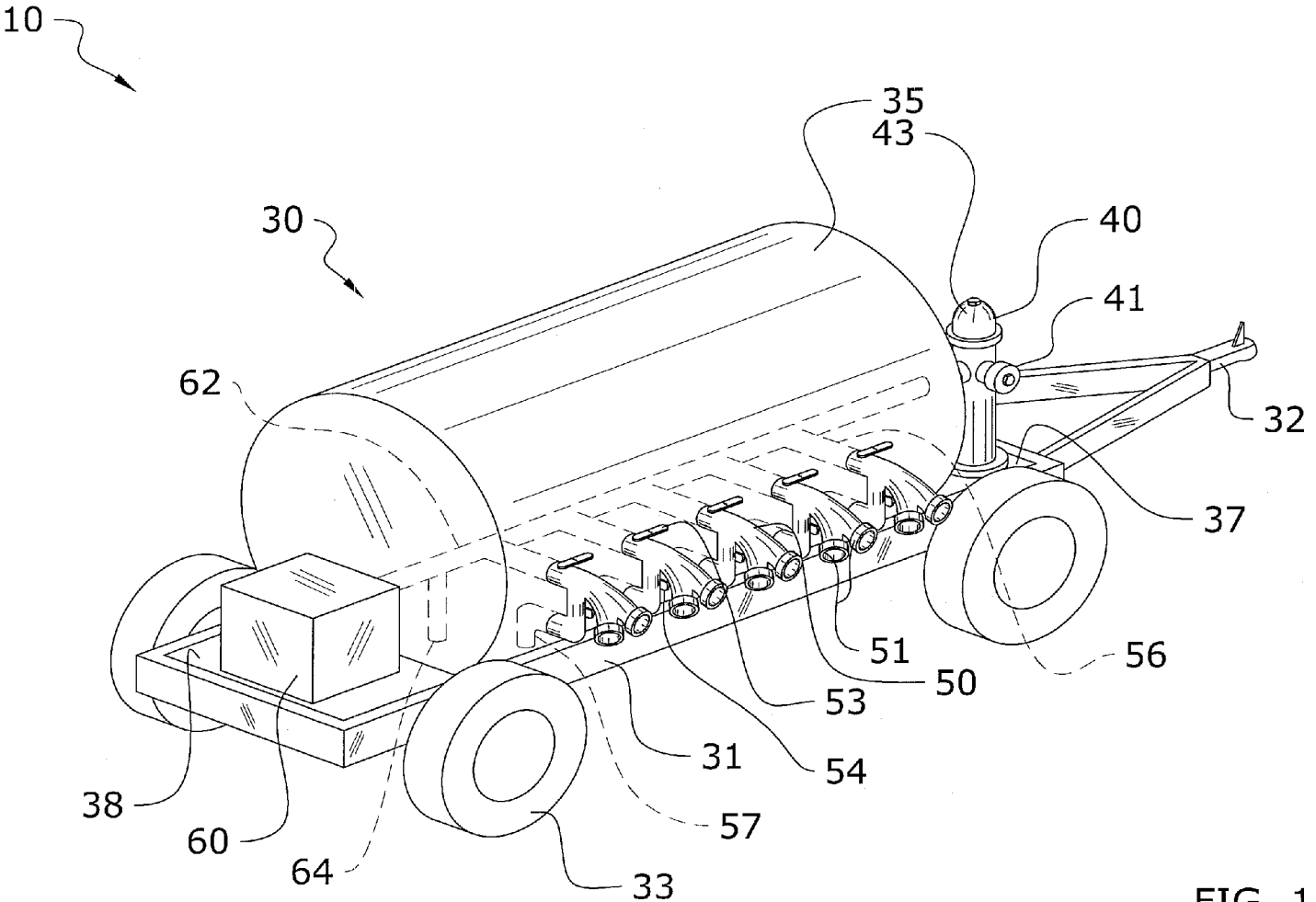
FIG. 1 is an upper perspective view of the present invention.
Figure 2:
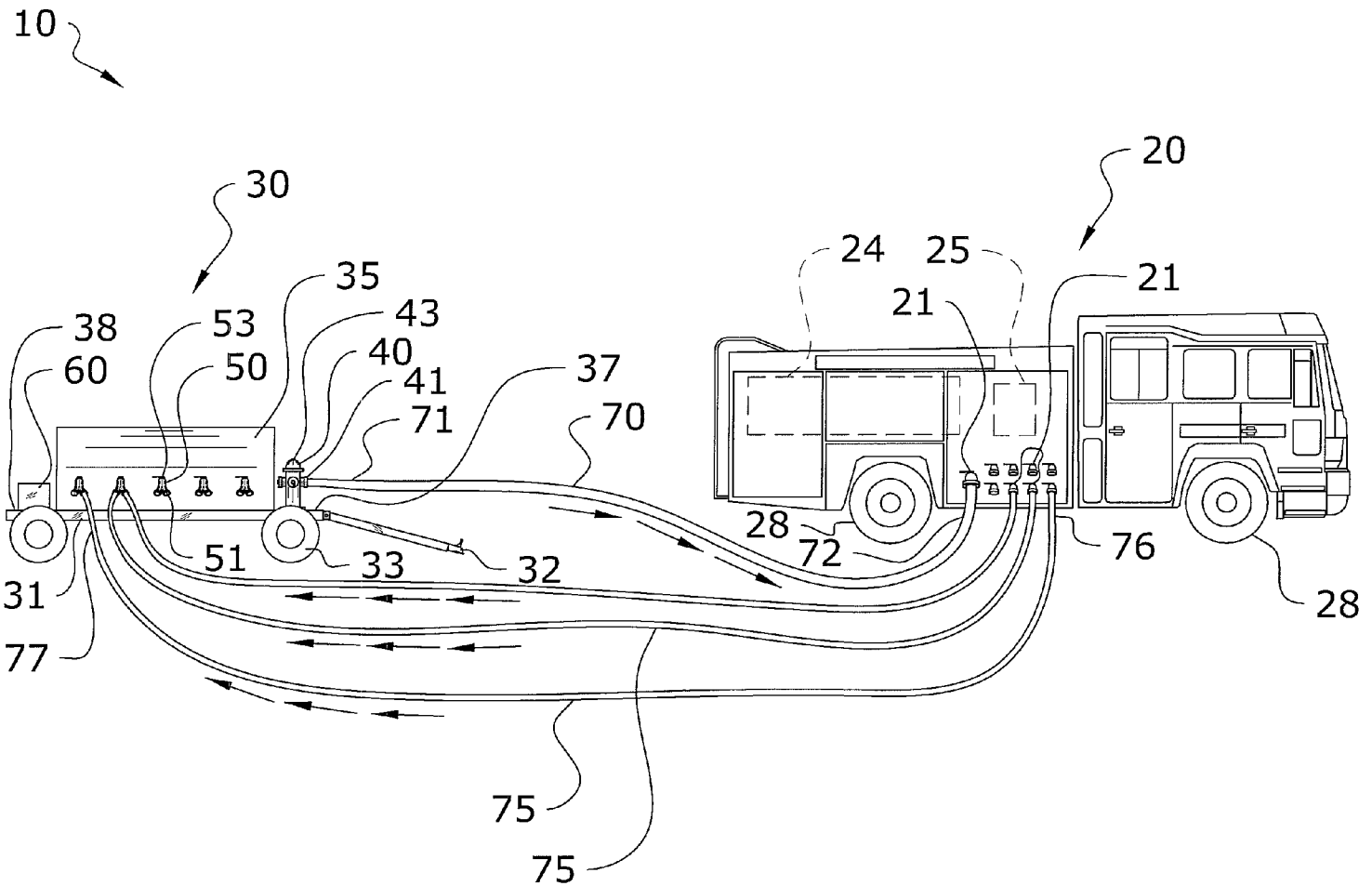
FIG. 2 is a side view of the present invention attached to a fire engine.
Figure 3:
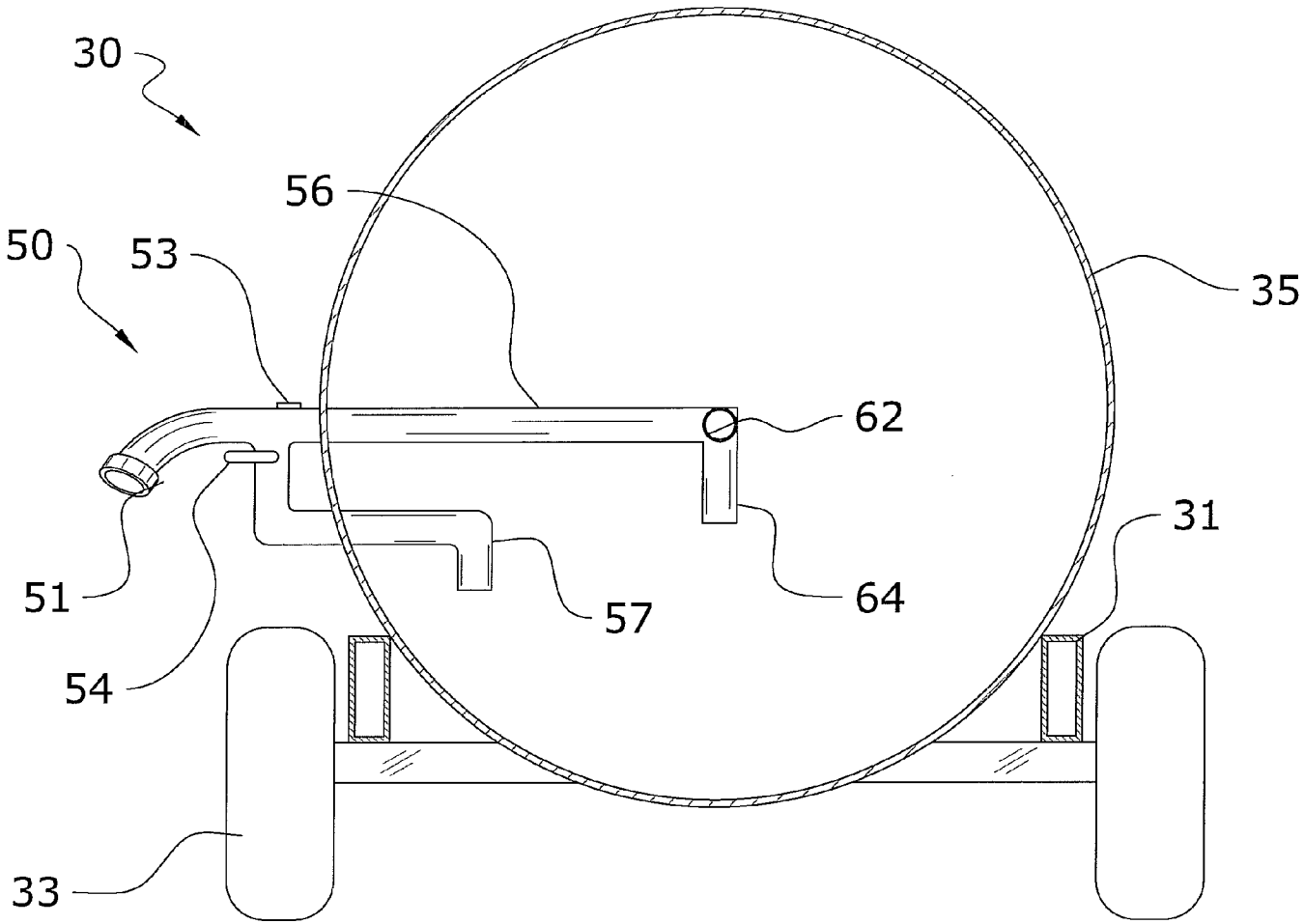
FIG. 3 is a sectional view of the present invention illustrating the elbow portion of the water intake.

Turning now descriptively to the drawings, in which similar reference characters denote similar elements throughout the several views, FIGS. 1 through 3 illustrate a water recycling and firefighting training apparatus 10, which comprises a frame 31 generally having wheels 33, a storage tank 35 mounted to the frame 31, a fire hydrant 40 mounted proximate or preferably to the frame 31, wherein the fire hydrant 40 is fluidly connected to the storage tank 35, a pump 60 fluidly connected to the storage tank 35 to pump water to the fire hydrant 40, and at least one intake 50 fluidly connected to the storage tank 35 for inputting water back within the storage tank 35. The water from the storage tank 35 is circulated between the mobile trailer 30 and a fire engine 20 through a plurality of hoses 70, 75 in a closed-loop configuration.

B. Fire Engine

The fire engine 20 is generally comprised of a conventional drivable vehicle designed to assist in fighting fires and including wheels 28, engine, chassis, a cab, a ladder, water pump 25, water storage tank 24, multiple hose connects 21, 22 for connecting and disconnecting water hoses 70, 75 therefrom, and various other components common to a fire engine. The fire engine 20 may be a particular vehicle used to actually fight fires and including components typical to a conventional fire engine or the fire engine 20 may be a student or training version of a conventional fire engine and include less fire fighting components (e.g. pump, storage tank, hose connects, etc.) or provide the fire fighting components on a smaller scale.

C. Mobile Trailer

The mobile trailer 30 is generally structures as a pull-type trailer and includes a receiver for connecting to a pulling vehicle, frame 31, receiver 31, and wheels 33 for providing mobility to the trailer 30. The mobile trailer 30, in alternate embodiments, may also be drivable as appreciated. The trailer 30 includes a storage tank 35 to hold a large volume of water and preferably comprised of a cylindrical shape (however other shapes may be appreciated). The storage tank 35 may include a fill port and a drain port. A ladder may also extend up the storage tank 35 for accessing the roof area. Alternately, the tank 35 may be filled through the water intakes 50. It is appreciated that the present invention may alternately be stationary and thus not positioned upon a mobile trailer.

The trailer 30 also generally includes a fire hydrant 40 mounted to the trailer 30 to simulate a conventional fire hydrant commonly found along the sides of streets and used by fire fighters. The fire hydrant 40 is generally mounted at a forward end of the frame 31 upon a front platform 37 as illustrated; however various mounting procedures may be utilized. The fire hydrant 40 is structured similarly to a conventional fire hydrant.

The fire hydrant 40 includes one or more hose connects 41 that are fluidly connected to the water pump 60. The hose connects 41, each including a port, allow for connecting and disconnecting the water hoses 70 in a standard manner similar to how a conventional water hose would connect to a conventional fire hydrant. The fire hydrant 40 also includes one or more valves and levers or other actuating members 43 for releasing the water from the water intakes 50 to support water pressure to the fire hydrant 40. The fire hydrant 40 is fluidly connected to the water pump 60 and the water intakes 50 through a series of pipes 56, 62.

The trailer 30 also generally includes one or more water intakes 50 and preferably a plurality of water intakes 50. The water intakes 50 generally line the sides of the storage tank 35 and include ports that are fluidly connected to the interior of the storage tank 35 and/or the fire hydrant 40. The water intakes 50 generally each include one or more hose connects 51 for attaching an initial hose 75 thereto.

The hose connects 51, each including a port, connect in a manner similar to a conventional connecting and disconnecting structure of a fire engine 20 to allow for the trainees to properly train connecting and disconnecting water hoses to a water source. The water intakes 50 are generally structured in a Y-shaped "clappered" hose connect 51 manner. The water intakes 50 may also include one or more valves and valve levers 53, 54 or other actuating members for releasing the water from the storage tank 35 or allowing water to be inputted within the storage tank 35, or pressurizing the fire hydrant 40.

The piping from the water intakes 50 extending within the storage tank 35 preferably includes an assist pipe 56 that extends directly to the supply pipe 62 connecting the water pump 60 to the fire hydrant 40. The water incoming through the water intakes 50 may be directed to the supply pipe 62 by opening a first valve 53 and thus assist in pressurizing the fire hydrant 40. The piping from the water intakes 50 may also include a fill pipe 57 which branches from the assist pipe 56 to direct the incoming water within the storage tank 35 by closing the first valve 53 and opening the second valve 54. The fill pipe 57 is generally angled at a 90 degree angle towards the floor of the storage tank 35 to prevent the highly pressurized water from damaging the interior walls of the storage tank 35 via being directly sprayed at the interior walls. It is appreciated that various other deflection structures may be used as appreciated rather than the elbow structure of the fill pipe 57. It is appreciated that both valves 53, 54 are operable outside of the storage tank 35.

The trailer 30 also includes one or more water pumps 60 to pump the water through the water hoses 70 leading from the trailer 30 to the fire engine 20. The water pump 60 may be powered in various manners. The power supply of the water pump 60 is generally self-contained upon the trailer 30 to allow the trailer 30 to be utilized for the training sessions in remote locations. The pump 60 is generally mounted at a rearward end of the frame 31 upon a rear platform 38 as illustrated; however various mounting procedures may be utilized. The pump 60 is fluidly connected to the fire hydrant 40 via at least one supply pipe 62 and fluidly connected to the storage tank 35 via at least one suction pipe 64 branching off of the supply pipe 62. The water pump 60 suctions the water from the storage tank 35 through the suction pipe 64 and transfers the water to the fire hydrant 40 via the supply pipe 62 for being transferred to the storage tank 24 of the fire engine 20.

D. Operation of Preferred Embodiment

In use, one or more initial hoses 75, each having a first end 76 and a second end 77, with the first end 76 and the second end 77 each having appropriate connectors is connected to the output hose connects 22 of the fire engine 20 and connected to the hose connects 51 of the water intakes 50. Additionally, one or more supply hoses 70, each having a first end 71 and a second end 72, with the first end 71 and the second end 72 each having appropriate connectors is connected to the hose connect 41 of the fire hydrant 40 and an input hose connect 21 of the fire engine 20.

The water pump 25 is operated to transfer the water from the storage tank 24 of the fire engine 20 to the storage tank 35 of the trailer 30 through the initial hoses 75, wherein the water is then transferred back to the storage tank 24 of the fire engine 20 through the fire hydrant 40 via the supply hose 70 and force of the water pump 60.

It is appreciated that the water may travel directly from the supply hose 70 to the initial hose 75 internally within the fire engine 20 or may be temporarily stored within the water storage tank 24 within the fire engine 20. The water transferred back to the trailer 30 from the fire engine 20 through the initial hoses 75 may be transferred via the water pump 25 from the fire engine 20 or the water pump 60 from the trailer 30 (through the supply hose).

The fire fighter trainees are able to practice connecting and disconnecting water hoses to the fire hydrant 40, water intakes 50, and fire engine 20. The fire fighter trainees may be timed during exercises or various other tutorial methods may be utilized during training. The water is able to circulate between the storage tank 35 of the trailer 30 to the fire engine 20 and back to the storage tank 35 of the trailer 30 in a closed-loop manner, thus not wasting any water during training exercises.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An apparatus used for firefighter training in conjuncture with a fire engine, comprising:
a frame;
a storage tank mounted to said frame;
a fire hydrant mounted proximate said frame;
wherein said fire hydrant is fluidly connected to said storage tank;
a pump mounted proximate said frame;
wherein said pump is fluidly connected to said storage tank to supply pressurized water to said fire hydrant for transferring water out of said storage tank; and
at least one water intake fluidly connected to said storage tank for transferring water within said storage tank;
at least one supply pipe fluidly connecting said water pump to said fire hydrant;
wherein said at least one water intake includes an assist pipe for directly fluidly connecting said at least one water intake to said at least one supply pipe;
wherein said at least one water intake includes a fill pipe branching off of said assist pipe for directly filling said storage tank;
wherein said at least one water intake includes a first valve for controlling water flow through said assist pipe and a second valve for controlling water flow through said fill pipe.

2. The apparatus of claim 1, wherein said frame has wheels to comprise a mobile trailer structure.

3. The apparatus of claim 1, wherein said at least one water intake includes a plurality of water intakes.

4. The apparatus of claim 1, wherein said at least one water intake has a Y-shaped hose connect.

5. The apparatus of claim 1, wherein said fire hydrant is mounted to said frame.

6. The apparatus of claim 1, wherein said water pump is mounted to said frame.

7. A firefighter training system, comprising:
a fire engine comprised of a drivable type, wherein said fire engine includes at least one input hose connect and at least one output hose connect;
a training apparatus separate from said fire engine, wherein said frame includes:
a storage tank mounted upon said frame;
a fire hydrant fluidly connected to said storage tank;
a pump fluidly connected to said storage tank; and
at least one water intake fluidly connected to said storage tank;
at least one initial hose connected to said at least one output hose connect and to said at least one water intake for transferring water from said fire engine to said training apparatus; and
at least one supply hose connected to said fire hydrant and said at least one input hose connect for transferring water from said training apparatus to said fire engine to form a closed-loop circulation of water between said training apparatus and said fire engine;
at least one supply pipe fluidly connecting said water pump to said fire hydrant;
wherein said at least one water intake includes an assist pipe having a first valve for directly fluidly connecting said at least one water intake to said at least one supply pipe;
wherein said at least one water intake includes a fill pipe having a second valve branching off of said assist pipe for directly filling said storage tank.

8. The firefighter training system of claim 7, wherein said training apparatus includes wheels to comprise a mobile structure.

9. The firefighter training system of claim 7, wherein said at least one water intake includes a plurality of water intakes.

10. The firefighter training system of claim 7, wherein said at least one water intake has a Y-shaped hose connect.

11. The firefighter training system of claim 7, wherein said fire hydrant is mounted to said frame.

12. The firefighter training system of claim 7, wherein said water pump is mounted to said frame.

13. A firefighter training system, comprising:
a fire engine comprised of a drivable type, wherein said fire engine includes:
a first water storage tank;
a first water pump fluidly connected to said first water storage tank;
at least one input hose connect fluidly connected to said first water storage tank; and
at least one output hose connect fluidly connected to said first water storage tank;
a mobile trailer having a frame including a receiver hitch and wheels, wherein said mobile trailer includes:
a second storage tank mounted upon said frame;
a fire hydrant mounted upon said frame, wherein said fire hydrant is fluidly connected to said second storage tank;
a second pump mounted upon said frame, wherein said second pump is fluidly connected to said second storage tank to supply said fire hydrant with pressurized water;
at least one supply pipe fluidly connecting said water pump to said fire hydrant, wherein said at least one supply pipe includes at least one suction pipe branching off of said at least one supply pipe for suctioning water from said second storage tank to within said at least one supply pipe; and
a plurality of water intakes extending from said second storage tank, wherein said plurality of water intakes are fluidly connected to said second storage tank;
wherein said plurality of water intakes each include a first hose connect and a second hose connect and wherein said first hose connect and said second hose connect comprise a Y-shaped structure;
wherein said at least one water intake includes an assist pipe for directly fluidly connecting said at least one water intake to said at least one supply pipe to assist in pressurizing said fire hydrant;
wherein said at least one water intake includes a fill pipe branching off of said assist pipe for directly filling said storage tank;
wherein said at least one water intake includes a first valve for controlling water flow through said assist pipe and a second valve for controlling water flow through said fill pipe;
at least one initial hose connected to said at least one output hose connect and to said at least one water intake for transferring water from said first storage tank to said second storage tank via said first pump; and
at least one supply hose connected to said fire hydrant and said at least one input hose connect for transferring water from said second storage tank to said first storage tank via said second pump to form a closed-loop circulation of water between said mobile trailer and said fire engine.

* * * * *